US007172267B2

(12) United States Patent
Furukawa

(10) Patent No.: US 7,172,267 B2
(45) Date of Patent: Feb. 6, 2007

(54) INK JET RECORDING METHOD AND INK JET RECORDING APPARATUS

(75) Inventor: Koji Furukawa, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 252 days.

(21) Appl. No.: 10/995,105

(22) Filed: Nov. 24, 2004

(65) Prior Publication Data

US 2005/0116994 A1 Jun. 2, 2005

(30) Foreign Application Priority Data

Nov. 27, 2003 (JP) ..... 2003-396697

(51) Int. Cl.
*B41J 2/06* (2006.01)

(52) U.S. Cl. ..... 347/55; 34/54

(58) Field of Classification Search ..... 347/20, 347/54, 55, 112, 128, 141
See application file for complete search history.

(56) References Cited

U.S. PATENT DOCUMENTS 4,684,957 A 8/1987 Miura et al. ..... 347/55
5,717,448 A * 2/1998 Inada ..... 347/43
6,158,844 A 12/2000 Murakami et al. ..... 347/55

* cited by examiner

*Primary Examiner*—Juanita D. Stephens
(74) *Attorney, Agent, or Firm*—Sughrue Mion, PLLC

(57) ABSTRACT

The ink jet recording method and apparatus apply an electrostatic force to ink including one or more charged fine particle components, eject ink droplets from ejection ports of ejection portions of an ink jet head, form at least one dot at an ejection frequency f on a recording medium and record an image thereon. The method and apparatus set an application time period of a drive voltage for ejecting the ink droplets upon ejection restart after ejection stop to a time period of 1/f or longer for at least one ejection portion, and apply the drive voltage to at least one ejection electrode of the ejection portions for the time period of 1/f or longer.

7 Claims, 3 Drawing Sheets

INK JET RECORDING METHOD AND INK JET RECORDING APPARATUS

This application claims priority on Japanese patent application No. 2003-396697, the entire contents of which are hereby incorporated by reference. In addition, the entire contents of literatures cited in this specification are incorporated by reference.

BACKGROUND OF THE INVENTION

The present invention belongs to a technical field of electrostatic ink jet recording. More specifically, the present invention relates to an electrostatic ink jet recording method with which a high quality image can be recorded with an appropriate dot diameter even in image recording at a high speed and to an ink jet recording apparatus which implements the ink jet recording method.

The following system is known as one of electrostatic ink jet recording systems for ejecting ink droplets by applying an electrostatic force to ink. According to the system, there is used ink including a fine particle component which contains a colorant and is charged (hereinafter, referred to as colorant particles), and ink ejection is controlled with the use of an electrostatic force by applying a predetermined voltage (drive voltage) based on image data to an ejection electrode (drive electrode) of an ink jet head, whereby an image corresponding to the image data is recorded on a recording medium.

For example, regarding such electrostatic ink jet recording using ink including colorant particles, JP 10-138493 A discloses an ink jet recording apparatus for ejecting ink droplets using an electrostatic force in which an ink guide is installed within a through-hole functioning as an ejection port for the ink droplets, an ejection electrode is formed so as to surround the through-hole, and a drive voltage having a polarity opposite from that of the colorant particles is applied to the ejection electrode.

It is preferable in such electrostatic ink jet recording that a bias voltage be previously applied to the ink and the drive voltage be applied to the ejection electrode, allowing the colorant particles to migrate to an ink ejection port under an electrostatic force (i.e., the ink is condensed in the ejection portion). In accordance with time elapse from the start of the drive voltage application, a meniscus of the ink grows to attain a state called "cylindrical Taylor cone" and further grows to have a state called "elongated columnar string". Then, the ink string is separated into ink droplets, which are to be ejected.

That is, in such electrostatic ink jet recording using the ink including the colorant particles, it takes a certain period of time from the start of the drive voltage application until the ejection of the ink droplet (hereinafter, referred to as ejection delay). When this ejection delay is significant, the ejection amount of the ink droplets per dot becomes insufficient, making the dot diameter of the ink formed on the recording medium smaller. As a result, an image of a desired quality may not be obtained.

Various methods are proposed for solving problems owing to the ejection delay. For example, regarding the electrostatic ink jet recording apparatus using the colorant particles, JP 10-258511 A discloses an ink jet recording apparatus which avoids such smaller dot diameter phenomenon owing to the ejection delay etc. by controlling a pulse width of a pulsed voltage applied to an ejection electrode for ejecting ink droplets in accordance with a recording pattern, enabling high quality image recording with a uniform dot diameter.

However, the ink jet recording apparatus disclosed in JP 10-258511 A cannot avoid the smaller dot diameter phenomenon owing to the ejection delay in various images to be recorded adequately with stability. In particular, when a recording frequency is set higher to perform image recording at a higher speed or a frequency of a pulsed drive voltage to be applied is set higher, the smaller dot diameter phenomenon becomes conspicuous.

SUMMARY OF THE INVENTION

It is an object of the present invention to solve the above related art problems and to provide an electrostatic ink jet recording apparatus for electrostatic ink jet recording in which ink including a charged fine particle component containing a colorant is used, the electrostatic ink jet recording apparatus being capable of preferably avoiding the smaller dot diameter phenomenon owing to time difference between start of ejection voltage application to an ejection electrode and ejection of an ink droplet and capable of recording a high quality image with dots having an appropriate diameter with stability even when image recording is performed at a high speed.

To achieve the above object, the present invention provides an electrostatic ink jet recording method in which an electrostatic force is applied to ink including one or more charged fine particle components to eject ink droplets from one or more ejection portions of an ink jet head and one or more dots are formed at an ejection frequency f on a recording medium to record an image thereon, the ink jet recording method including setting an application time period of a drive voltage for ejecting the ink droplets upon ejection restart after ejection stop to a time period of 1/f or longer for at least one ejection portion.

In further aspect of the ink jet recording method of the present invention, it is preferable that the application time period of the drive voltage for ejecting the ink droplets be set to the time period of 1/f or longer for an ejection portion where an ejection stopping state in which no ink droplet is ejected satisfies a predetermined condition or only in one or more ejection portions where the ink droplets are not ejected equal to or more than a predetermined condition, and set to a time period shorter than 1/f for an ejection portion where said ejection stopping state does not satisfy said predetermined condition or in one or more ejection portions where the ink droplets are not ejected less than the predetermined condition. More preferably, the application time period of the drive voltage for ejecting the ink droplets upon ejection restart is adjusted in a range of 1/f to 2/f in accordance with an ejection stopping state where no ink droplet is ejected.

In addition, the present invention provides an electrostatic ink jet recording apparatus for applying an electrostatic force to ink including one or more charged fine particle components to eject ink droplets from one or more ejection portions of an ink jet head and forming one or more dots at an ejection frequency f on a recording medium to record an image thereon, the ink jet recording apparatus including: an ejection port substrate having one or more ejection ports for ejecting the ink droplets; a head substrate disposed so as to face the one or more ejection ports substrate while being apart at a predetermined distance; an ejection electrode for ejecting the ink droplets from the one or more ejection ports; one or more ejection electrodes formed corresponding to the one or more ejection ports and adapted to apply an electrostatic force to the ink for ejecting ink to allow the ink droplets to be ejected from the one or more ejection ports; and ejection control means for applying to the one or more ejection electrodes a drive voltage for ink droplet ejection to drive the one or more ejection electrodes, in which the ejection control means applies the drive voltage to the one or more ejection electrodes for a time period of 1/f or longer upon ejection restart after ejection stop.

In further aspect of the ink jet recording apparatus of the present invention, it is preferable that an ejection portion includes an ejection port and an ejection electrode and the ejection control means applies the drive voltage to the ejection electrode for the time period of 1/f or longer in an ejection portion where an ejection stopping state in which no ink droplet is ejected satisfies a predetermined condition or only in one or more ejection portions where the ink droplets are not ejected equal to or more than a predetermined condition, and for a time period shorter than 1/f in an ejection portion where the ejection stopping state does not satisfy the predetermined condition or in one or more ejection portions where the ink droplets are not ejected less than the predetermined condition, and that the ejection control means adjusts the time period of the drive voltage application upon ejection restart after ejection stop in a range of 1/f to 2/f in accordance with an ejection stopping state where no ink droplet is ejected.

More preferably, the ejection control means applies the drive voltage to the ejection electrode for the time period of 1/f or longer by one of: starting the drive voltage application at a timing earlier than start of predetermined voltage application in accordance with the ejection frequency f; terminating voltage application at a timing later than latest termination of the voltage application in accordance with the ejection frequency f; and starting the drive voltage application at a timing earlier than start of predetermined voltage application in accordance with the ejection frequency f and terminating voltage application at a timing later than latest termination of the voltage application in accordance with the ejection frequency f.

According to the present invention, in the electrostatic ink jet recording using the ink which includes the charged fine particles containing the colorant (colorant particles), even when high-speed image recording is performed, the smaller dot diameter phenomenon owing to the time difference (ejection delay) between the ejection voltage application to the ejection electrode and the ink droplet ejection is preferably avoided, whereby a high quality image with dots having an appropriate diameter can be recorded with stability.

DESCRIPTION OF THE PREFERRED EMBODIMENTS

Hereinafter, an ink jet recording method and an ink jet recording apparatus according to the present invention will be described in detail by way of preferred embodiments shown in the accompanying drawings.

Figure 1A:
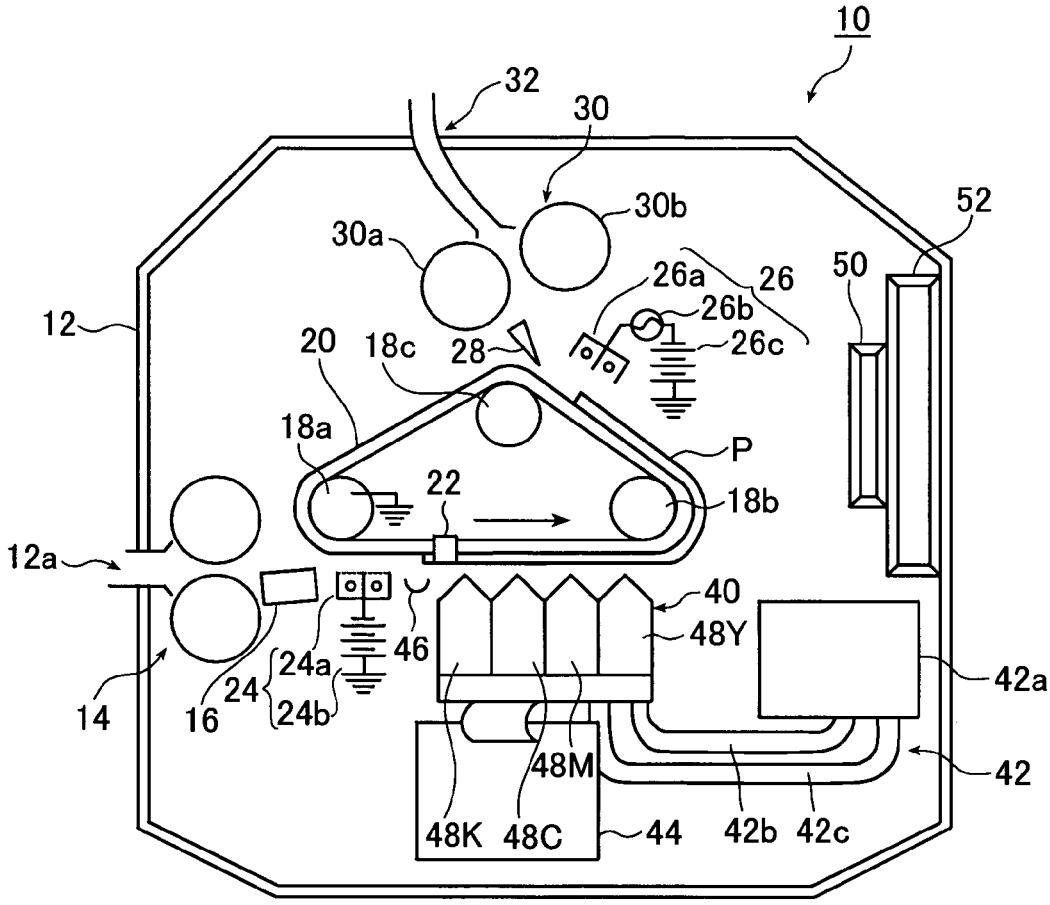
FIG. 1A is a conceptual diagram of an example of an ink jet printer using an ink jet recording apparatus according to the present invention.
Figure 1B:
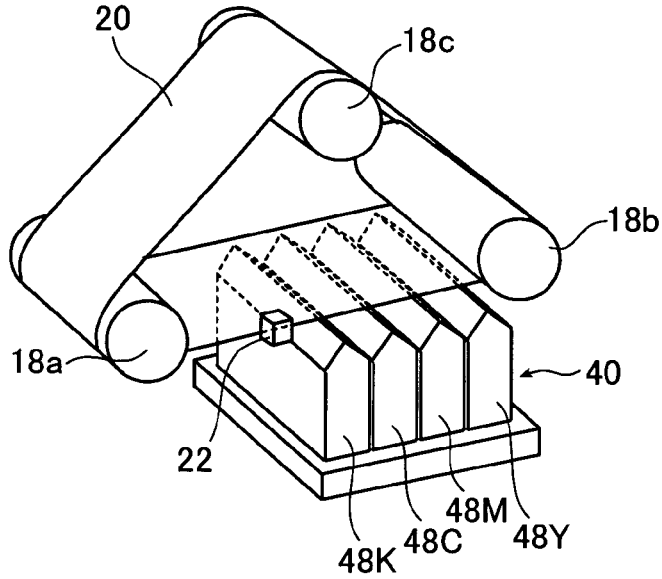
FIG. 1B is a partially enlarged perspective view of FIG. 1A.

FIG. 1A is a conceptual diagram of an example of an ink jet printer using the ink jet recording apparatus of the present invention which carries out the ink jet recording method according to the present invention, and FIG. 1B is a partially enlarged view thereof (in which a conveyor belt 20, a head unit 40, etc., are shown).

An ink jet printer 10 (hereinafter, referred to as printer 10) shown in FIGS. 1A and 1B is an apparatus for performing four-color one-side printing on a recording medium P. The printer includes conveyor means for the recording medium P, image recording means, and solvent collecting means, all of which are accommodated in a casing 12.

The conveyor means includes a feed roller pair 14, a guide 16, rollers 18 (18*a*, 18*b*, and 18*c*), the conveyor belt 20, conveyor belt position detecting means 22, electrostatic attraction means 24, discharge means 26, peeling means 28, fixation/conveyance means 30, and a guide 32. The image recording means includes the head unit 40, an ink circulating system 42, an ejection control portion 44, and recording medium position detecting means 46. The solvent collecting means includes a discharge blower 50, and a solvent collecting device 52.

In the conveyor means for the recording medium P, the feed roller pair 14 is a conveyance roller pair for nipping the recording medium P fed into the casing 12 via a feeding port 12*a* from a paper cassette (not shown) installed outside the casing 12 and conveying the nipped medium P to be sent to the conveyor belt 20 (a portion supported by the roller 18*a* in the shown example).

The guide 16 is disposed between the feed roller pair 14 and the roller 18*a* for supporting the conveyor belt 20 and guides the recording medium P fed by the feed roller pair 14 to the conveyor belt 20.

Foreign matter removal means for removing foreign matter such as dust or paper powder adhered to the recording medium P is preferably disposed in the vicinity of the feed roller pair 14.

As the foreign matter removal means, one or more of known methods including non-contact removal methods such as suction removal, blowing removal and electrostatic removal, and contact removal methods such as removal using a blush, a roller, etc., may be used in combination. It is also possible that the feed roller pair 14 is composed of a slightly adhesive roller, a cleaner is prepared for the feed roller pair 14, and foreign matter such as dust or paper powder is removed when the feed roller pair 14 feeds the recording medium P.

The conveyor belt 20 is an endless belt extended over the three rollers 18 (18*a*, 18*b*, and 18*c*). At least one of the rollers 18*a*, 18*b*, and 18*c* is connected to a drive source (not shown) to rotate the conveyor belt 20.

The conveyor belt 20 conveys the fed recording medium P from a position corresponding to the head unit 40 to a position corresponding to the fixation/conveyance means 30 via a position corresponding to the discharge means 26. At the time of image recording by the head unit 40, the conveyor belt 20 functions as scanning conveyor means for the recording medium P and also as a platen for holding the recording medium P. Therefore, the conveyor belt 20 is preferably made of a material which is excellent in dimension stability and has durability.

In the shown example, the recording medium P is held on the conveyor belt 20 under electrostatic attraction. In correspondence with this, the conveyor belt 20 has insulating properties on a side on which the recording medium P is held (front face), and conductive properties on the other side on which the belt 20 contacts the rollers 18 (rear face). Further, in the shown example, the roller 18*a* is a conductive roller, and the rear face of the conveyor belt 20 is grounded via the roller 18*a*.

The conveyor belt 20 also functions as a counter electrode for an ejection electrode 80 (see FIG. 2) described later upon electrostatic ink jet image recording on the recording medium P also to be described later.

A belt having a metal layer and an insulating material layer manufactured by a variety of methods, such as a metal belt coated with known resin material, for example, fluoroplastic on the front face, a belt obtained by bonding a resin sheet to a metal belt with an adhesive or the like, and a belt obtained by performing vapor-depositing a metal on the rear face of a belt made of the above-mentioned resin may be used as the conveyor belt 20.

The conveyor belt 20 preferably has the flat front face contacting the recording medium P, whereby satisfactory attraction properties of the recording medium P can be obtained.

Meandering of the conveyor belt 20 is preferably suppressed by a known method. An example of a meandering suppression method is that the roller 18*c* is composed of a tension roller, a shaft of the roller 18*c* is inclined with respect to shafts of the rollers 18*a* and 18*b* in response to an output of the conveyor belt position detecting means 22, that is, a position of the conveyor belt 20 detected in a sub scanning direction (width direction), thereby changing a tension at both ends of the conveyor belt in the width direction to suppress the meandering. The rollers 18 may have a taper shape, a crown shape, or another shape to suppress the meandering.

The conveyor belt position detecting means 22 suppresses the meandering of the conveyor belt etc. in the above manner and detects the position of the conveyor belt 20 in the sub scanning direction to regulate the recording medium P to situate at a predetermined position at the time of image recording. Known detecting means such as a photo sensor may be used.

The electrostatic attraction means 24 charges the recording medium P to a bias voltage with respect to the head unit 40 (ink jet head), and charges the recording medium P to have a predetermined potential of a polarity opposite from that of the charge of colorant particles of ink described later such that the recording medium P is attracted and held on the conveyor belt 20 under an electrostatic force. For example, when the colorant particles are positively charged, the recording medium P is charged to −1,500 V.

In the shown example, the electrostatic attraction means 24 includes a scorotron charger 24*a* for charging the recording medium P and a negative high voltage power source 24*b* connected to the scorotron charger 24*a*. While being conveyed by the feed roller pair 14 and the conveyor belt 20, the recording medium P is charged to a negative bias voltage by the scorotron charger 24*a* connected to the negative high voltage power source 24*b* and attracted to the insulating layer of the conveyor belt 20.

Note that a conveying speed of the conveyor belt 20 when charging the recording medium P may be in a range where the charging is performed with stability, so the speed may be the same as, or different from, a conveying speed at the time of image recording. Also, the electrostatic attraction means may act on the same recording medium P several times by circulating the recording medium P several times on the conveyor belt 20 for uniform charging.

In the shown example, in the electrostatic attraction means 24, the electrostatic attraction and the charging for the recording medium P are performed, but the electrostatic attraction means and the charging means may be provided separately.

The electrostatic attraction means is not limited to the scorotron charger 24*a* of the shown example; a corotron charger, a solid-state charger, an electrostatic discharge needle, and various means and methods can be employed. As will be described in detail later, at least one of the rollers 18 is composed of a conductive roller, or a conductive platen is disposed on the rear side of the conveyor belt 20 in a recording position for the recording medium P (side opposite to the recording medium P). Then, the conductive roller or the conductive platen is connected to the negative high voltage power source, thereby forming the electrostatic attraction means 24. Alternatively, it is also possible that the conveyor belt 20 is composed of an insulating belt and the conductive roller is grounded to connect the conductive platen to the negative high voltage power source.

The recording medium P charged by the electrostatic attraction means 24 and held on the conveyor belt 20 is conveyed to a position of the image recording means (head unit 40) by the conveyor belt 20.

As described above, the image recording means includes the head unit 40, the ink circulating system 42, the ejection control portion 44, and the recording medium position detecting means 46.

The head unit 40 ejects ink droplets of four colors: cyan (C), magenta (M), yellow (Y), and black (K), in accordance with an image to be recorded, thereby recording a full color image on the recording medium P.

For the four-color ink ejection, the head unit 40 includes four ink jet heads 48 (48C, 48M, 48Y, and 48K) and ejects ink Q supplied via the ink circulating system 42 in the form of ink droplets R by a drive voltage supplied from the ejection control portion 44, thereby recording an image on the recording medium P conveyed at a predetermined speed by the conveyor belt 20.

In the shown example, each of the ink jet heads 48 is a line head including ink ejection ports 64 disposed in the entire area in the width direction of the recording medium P having an affordable maximum size (direction orthogonal to the direction in which the conveyor belt 20 conveys the medium P; hereinafter, referred to as sub scanning direction). The ink jet heads 48 are disposed in the conveying direction of the conveyor belt 20.

Therefore, in the shown example, while the recording medium P is held on the conveyor belt 20, the recording medium P is conveyed to pass over the head unit 40 once. In other words, scanning and conveyance are performed only once for the head unit 40. Then, an image is formed on the entire surface of the recording medium P.

Note that the ink jet recording apparatus of the present invention is also applicable to a so-called serial head (shuttle type), and therefore the printer 10 may take this configuration.

In this case, the head unit 40 is structured such that a line (which may have a single line or multi channel structure) of the ejection ports 64 for each ink jet head 48 agrees with the conveying direction of the conveyor belt 20, and the head unit 40 is provided with known scanning means which scans the head unit 40 in the sub scanning direction. Image recording may be performed as in a usual shuttle type ink jet recording printer. In accordance with a length of the line of the ejection ports 64, the recording medium P is conveyed intermittently by the conveyor belt 20, and in synchronization with this intermittent conveying, the head unit 40 is scanned when the recording medium is at rest, whereby an image is formed on the entire surface of the recording medium P.

The recording medium position detecting means 46 detects the recording medium P being fed to a position at which an ink droplet is ejected onto the medium P from the head unit 40, and known detecting means such as photo sensor can be used.

The ejection control portion 44 receives image data from an external device and supplies a drive voltage for ejecting ink droplets to the head unit 40 based on the image data.

More specifically, the ejection control portion 44 executes various necessary processes such as color separation and division operation to obtain appropriate pixel number and grayscale level on image data received from the external device such as a computer, an RIP, an image scanner, a magnetic disc device, or an image data transmission device, thus obtaining image data for ejection corresponding to the image recording by the head unit 40. Further, the ejection control portion 44 supplies a drive voltage based on the image data for ejection to each ink jet head 48 of the head unit 40 (or the ejection electrode 80 thereof), at a conveying timing of the recording medium P by the conveyor belt 20, thereby ejecting the ink droplets. Control for the timing is performed with the use of an output from the recording medium position detecting means 46 or an output signal from an encoder provided on the conveyor belt 20 or the drive means of the conveyor belt 20.

Here, when the number of the ejection portions to be controlled (the number of channels) is large as in the case where a line head is used, the ejection control portion 44 may separate rendering to employ a known method such as resistance matrix type drive method or resistance diode matrix type drive method. Thus, it is possible to reduce the number of ICs used in the ejection control portion 44 and suppress the size of a control circuit while lowering costs.

Although a description will be given later, the ink jet heads 48 use a charge potential of the recording medium P for the bias voltage and apply a drive voltage to the ejection electrodes 80, whereby the drive voltage is superposed on the bias voltage and the ink droplets R are ejected to record an image on the recording medium P. At this time, the conveyor belt 20 is provided with heating means to increase a temperature of the recording medium P, thus promoting fixation of the ink droplets R on the recording medium P and further suppressing ink bleeding, which leads to improvement in image quality.

Electrostatic ink jet recording using the ink jet heads 48 and the ejection control portion 44 will be described in detail below.

The ink circulating system 42 allows corresponding ink Q to flow in an ink flow path 74 (see FIG. 2) of each ink jet head 48 of the head unit 40. For each of the ink of the four colors (C, M, Y, K), the ink circulating system 42 includes: an ink circulating device 42*a* having an ink tank, a pump, a replenishment ink tank (not shown), etc.; an ink supply system 42*b* for supplying the ink Q corresponding to the ink flow path 74 of each ink jet head 48 from the ink circulating device 42*a;* and an ink recovery system 42*c* for recovering the ink from the ink flow path 74 of each ink jet head 48 into the ink circulating device 42*a.*

An arbitrary system may be used for the ink circulating system 42 as long as this system supplies the ink Q of a color corresponding to each ink jet head 48 of the head unit 40 from the ink tank and recovers the ink from each ink jet head 48 to allow ink circulation in a path for returning the ink into the corresponding color ink tank.

The concentration of ink circulating in the ink circulating system 42 lowers because the ink is condensed and ejected from the head unit 40. Therefore it is preferable in the ink circulating system 42 that the ink concentration be detected by an ink concentration detecting device and the ink tank be replenished as required with ink from the replenishment ink tank to keep the ink concentration in the predetermined range.

Moreover, the ink tank is preferably provided with an agitator for suppressing precipitation/aggregation of solid components of the ink and an ink temperature control device for suppressing ink temperature change. According to the electrostatic ink jet recording, when the ink temperature changes due to ambient temperature change or the like, physical properties of the ink are changed, which causes the dot diameter change. As a result, a high quality image may not be recorded with stability. However, when the temperature control is performed, such drawbacks can be prevented reliably.

A rotary blade, an ultrasonic transducer, a circulation pump, or the like may be used for the agitator. The head unit 40, the ink tank, an ink supply line and other components are provided with a heating element such as a heater or a cooling element such as Peltier element as the ink temperature control device, and any known method, for example, a method in which control is performed with a temperature sensor like a thermostat can be used. When arranged inside the ink tank, the temperature control device is preferably arranged with the agitator such that temperature distribution is kept constant. Then, the agitator for keeping the concentration distribution in the tank constant may double as the agitator for suppressing the precipitation/aggregation of solid components of the ink.

Here, ink Q (ink composition) used in the ink jet recording apparatus of the present invention is obtained by dispersing charged fine particles which contain colorants (hereinafter referred to as colorant particles) in a carrier liquid (dispersion solvent).

The carrier liquid is preferably a dielectric liquid (non-aqueous solvent) having a high electrical resistivity (equal to or larger than $10^9$ Ω·cm, and more preferably equal to or larger than $10^{10}$ Ω·cm). If the electrical resistivity of the carrier liquid is low, the concentration of the colored particles does not occur since the carrier liquid itself receives the injection of the electric charges to be charged due to a drive voltage applied to the ejection electrodes. In addition, since there is also anxiety that the carrier liquid having a low electrical resistivity causes the electrical conduction between the adjacent ejection portions, the carrier liquid having a low electrical resistivity is unsuitable for the present invention.

A relative permittivity of the dielectric liquid used as the carrier liquid is preferably equal to or smaller than 5, more preferably equal to or smaller than 4, and much more preferably equal to or smaller than 3.5. Such a range is selected for the relative permittivity, whereby the electric field effectively acts on the colored particles contained in the carrier liquid to facilitate the electrophoresis of the colored particles.

Note that an upper limit of the specific electrical resistance of such a carrier liquid is desirably about $10^{16}$ Ω·cm, and a lower limit of the relative permittivity is desirably about 1.9. The reason why the electrical resistance of the carrier liquid preferably falls within the above-mentioned range is that if the electrical resistance becomes low, then the ejection of the ink under a low electric field becomes worse. Also, the reason why the relative permittivity preferably falls within the above-mentioned range is that if the relative permittivity becomes high, then the electric field is relaxed due to the polarization of the solvent, and as a result the color of dots formed under this condition becomes light, or the bleeding occurs.

Preferred examples of the dielectric liquid used as a carrier liquid include straight-chain or branched aliphatic hydrocarbons, alicyclic hydrocarbons, aromatic hydrocarbons, and the same hydrocarbons substituted with halogens. Specific examples thereof include hexane, heptane, octane, isooctane, decane, isodecane, decalin, nonane, dodecane, isododecane, cyclohexane, cyclooctane, cyclodecane, benzene, toluene, xylene, mesitylene, Isopar C, Isopar E, Isopar G, Isopar H, Isopar L, Isopar M (Isopar: a trade name of EXXON Corporation), Shellsol 24, Shellsol 71 (Shellsol: a trade name of Shell Oil Company), AMSCO OMS, AMSCO 460 Solvent, (AMSCO: a trade name of Spirits Co., Ltd.), a silicone oil (such as KF-96L, available from Shin-Etsu Chemical Co., Ltd.). The dielectric liquid may be used singly or as a mixture of two or more thereof.

For such colored particles dispersed in the carrier liquid, colorants themselves may be dispersed as the colored particles into the carrier liquid. Alternatively, the colored particles may also be contained in dispersion resin particles for enhancement of fixing property. In the case where the colorants are contained in the dispersion resin particles, in general, there is adopted a method in which the pigments or the like are covered with the resin material of the dispersion resin particles to obtain the particles covered with the resin, or the dispersion resin particles are colored with the dyes or the like to obtain the colored particles.

As the colorants, all the ink composition for ink jet recording, the (oily) ink composition for printing, or the pigments and dyes used in the liquid developer for electrostatic photography may be used as in the past.

Pigments used as colorants may be inorganic pigments or organic pigments commonly employed in the field of printing technology. Specific examples thereof include but are not particularly limited to known pigments such as carbon black, cadmium red, molybdenum red, chrome yellow, cadmium yellow, titanium yellow, chromium oxide, viridian, cobalt green, ultramarine blue, Prussian blue, cobalt blue, azo pigments, phthalocyanine pigments, quinacridone pigments, isoindolinone pigments, dioxazine pigments, threne pigments, perylene pigments, perinone pigments, thioindigo pigments, quinophthalone pigments, and metal complex pigments.

Preferred examples of dyes used as colorants include oil-soluble dyes such as azo dyes, metal complex salt dyes, naphthol dyes, anthraquinone dyes, indigo dyes, carbonium dyes, quinoneimine dyes, xanthene dyes, aniline dyes, quinoline dyes, nitro dyes, nitroso dyes, benzoquinone dyes, naphthoquinone dyes, phthalocyanine dyes, and metal phthalocyanine dyes.

Further, examples of dispersion resin particles include rosins, rosin-modified phenol resin, alkyd resin, a (meta) acryl polymer, polyurethane, polyester, polyamide, polyethylene, polybutadiene, polystyrene, polyvinyl acetate, acetal-modified polyvinyl alcohol, and polycarbonate.

Of those, from the viewpoint of ease for particle formation, a polymer having a weight average molecular weight in a range of 2,000 to 1,000,000 and a polydispersity (weight average molecular weight/number average molecular weight) in a range of 1.0 to 5.0 is preferred. Moreover, from the viewpoint of ease for the fixation, a polymer in which one of a softening point, a glass transition point, and a melting point is in a range of 40° C. to 120° C. is preferred.

In the ink Q, a content of colorant particles (a total content of colorant particles and dispersion resin particles) preferably falls within a range of 0.5 to 30.0 wt % for the overall ink, more preferably falls within a range of 1.5 to 25.0 wt %, and much more preferably falls within a range of 3.0 to 20.0 wt %. If the content of colorant particles decreases, the following problems become easy to arise. The density of the printed image is insufficient, the affinity between the ink Q and the surface of the recording medium P becomes difficult to obtain to prevent the image firmly stuck to the surface of the recording medium P from being obtained, and so forth. On the other hand, if the content of colorant particles increases, problems occur in that the uniform dispersion liquid becomes difficult to obtain, the clogging of the ink Q is easy to occur in the ink jet head 48 or the like to make it difficult to obtain the stable ink ejection, and so forth.

In addition, an average particle diameter of the colorant particles dispersed in the carrier liquid preferably falls with in a range of 0.1 to 5.0 μm, more preferably falls within a range of 0.2 to 1.5 μm, and much more preferably falls within a range of 0.4 to 1.0 μm. Those particle diameters are measured with CAPA-500 (a trade name of a measuring apparatus manufactured by HORIBA LTD.).

After the colorant particles are dispersed in the carrier liquid and optionally a dispersing agent, a charging control agent is added to the resultant carrier liquid to charge the colorant particles, and the charged colorant particles are dispersed in the resultant liquid to thereby produce the ink Q. Note that in dispersing the colorant particles in the carrier liquid, a dispersion solvent may be added if necessary.

As the charging control agent, for example, various ones used in the electrophotographic liquid developer can be utilized. In addition, it is also possible to utilize various charging control agents described in "DEVELOPMENT AND PRACTICAL APPLICATION OF RECENT ELECTRONIC PHOTOGRAPH DEVELOPING SYSTEM AND TONER MATERIALS", pp. 139 to 148; "ELECTROPHOTOGRAPHY-BASES AND APPLICATIONS", edited by THE IMAGING SOCIETY OF JAPAN, and published by CORONA PUBLISHING CO. LTD., pp. 497 to 505, 1988; and "ELECTRONIC PHOTOGRAPHY" by Yuji Harasaki, 16(No. 2), p. 44, 1977.

Note that the colorant particles may be positively or negatively charged as long as the charged colorant particles are identical in polarity to the drive voltages applied to ejection electrodes 80.

In addition, a charging amount of colorant particles is preferably in a range of 5 to 200 μC/g, more preferably in a range of 10 to 150 μC/g, and much more preferably in a range of 15 to 100 μC/g.

In addition, the electrical resistance of the dielectric liquid may be changed by adding the charging control agent in some cases. Thus, a distribution factor P defined below is preferably equal to or larger than 50%, more preferably equal to or larger than 60%, and much more preferably equal to or larger than 70%.

$$P=100\times(\sigma 1-\sigma 2)/\sigma 1$$

where $\sigma 1$ is an electric conductivity of the ink Q, and $\sigma 2$ is an electric conductivity of a supernatant liquid which is obtained by inspecting the ink Q with a centrifugal separator.

Those electric conductivities were obtained by measuring the electric conductivities of the ink Q and the supernatant liquid under a condition of an applied voltage of 5 V and a frequency of 1 kHz using an LCR meter of an AG-4311 type (manufactured by ANDO ELECTRIC CO., LTD.) and electrode for liquid of an LP-05 type (manufactured by KAWAGUCHI ELECTRIC WORKS, CO., LTD.). In addition, the centrifugation was carried out for 30 minutes under a condition of a rotational speed of 14,500 rpm and a temperature of 23° C. using a miniature high speed cooling centrifugal machine of an SRX-201 type (manufactured by TOMY SEIKO CO., LTD.).

The ink Q as described above is used, which results in that the colorant particles are likely to migrate and hence the colorant particles are easily concentrated.

The electric conductivity of the ink Q is preferably in a range of 100 to 3,000 pS/cm, more preferably in a range of 150 to 2,500 pS/cm, and much more preferably in a range of 200 to 2,000 pS/cm. The range of the electric conductivity as described above is set, resulting in that the applied voltages to the ejection electrodes are not excessively high, and also there is no anxiety to cause the electrical conduction between the adjacent ejection electrodes.

In addition, a surface tension of the ink Q is preferably in a range of 15 to 50 mN/m, more preferably in a range of 15.5 to 45.0 mN/m, and much more preferably in a range of 16 to 40 mN/m. The surface tension is set in this range, resulting in that the applied voltages to the ejection electrodes are not excessively high, and also the ink does not leak or spread to the periphery of the head to contaminate the head.

Moreover, a viscosity of the ink Q is preferably in a range of 0.5 to 5.0 mPa·sec, more preferably in a range of 0.6 to 3.0 mPa·sec, and much more preferably in a range of 0.7 to 2.0 mPa·sec.

The ink Q can be prepared for example by dispersing colorant particles into a carrier liquid to form particles and adding a charging control agent to the dispersion medium (dispersion solvent) to allow the colorant particles to be charged. The following methods are given as the specific methods.

(1) A method including: previously mixing (kneading) a colorant and/or dispersion resin particles; dispersing the resultant mixture into a carrier liquid using a dispersing agent when necessary; and adding the charging control agent thereto.

(2) A method including: adding a colorant and/or dispersion resin particles and a dispersing agent into a carrier liquid at the same time for dispersion; and adding the charging control agent thereto.

(3) A method including adding a colorant and the charging control agent and/or the dispersion resin particles and the dispersing agent into a carrier liquid at the same time for dispersion.

In the above-mentioned way, the recording medium P on which the image is formed by the head unit 40 is discharged by the discharge means 26 and peeled off the conveyor belt 20 by the peeling means 28 before being conveyed to the fixation/conveyance means 30.

In the shown example, the discharge means 26 is a so-called AC corotron discharger, which includes a corotron discharger 26*a*, an AC power source 26*b*, and a DC high voltage power source 26*c* with one end grounded. In addition thereto, various means and methods, for example, a scorotron discharger, a solid-state charger, and an electrostatic discharge needle can be used for discharge. Also, as in the electrostatic attraction means 24 described above, a structure using a conductive roller or a conductive platen can also be preferably utilized.

A known technique such as a peeling blade, a counterrotating roller, an air knife is applicable to the peeling means 28.

The recording medium P peeled off the conveyor belt 20 is sent to the fixation/conveyance means 30 where the image formed by means of the ink jet recording is fixed. A pair of rollers composed of a heat roller 76*a* and a conveying roller 76*b* is used as the fixation/conveyance means 30 to heat and fix the recorded image while nipping and conveying the recording medium P.

The recording medium P on which the image is fixed is guided by the guide 32 and delivered to a delivered paper tray (not shown).

In addition to the heat roll fixation described above, examples of the heat fixation means include irradiation with infrared rays or using a halogen lamp or a xenon flash lamp, and general heat fixation such as hot air fixation using a heater. Further, in the fixation/conveyance means 30, it is also possible that the heating means is used only for heating, and the conveyance means and the heat fixation means are provided separately.

It should be noted that in the case of heat fixation, when a sheet of coated paper or laminated paper is used as the recording medium P, there is a possibility of causing a phenomenon called "blister" in which irregularities are formed on the sheet surface since moisture inside the sheet abruptly evaporates due to rapid temperature increase. To avoid this, it is preferable that a plurality of fixing devices be arranged, and at least one of power supply to the respective fixing devices and a distance from the respective fixing devices to the recording medium P be changed such that the temperature of the recording medium P gradually increases.

The printer 10 is preferably constructed such that no components will contact the image recording surface of the recording medium P at least during a time from the image recording with the head unit 40 until the completion of fixation with the fixation/conveyance means 30.

Further, the movement speed of the recording medium P at the time of fixation with the fixation/conveyance means 30 is not particularly limited, which may be the same as, or different from, the conveying speed by the conveyor belt 20 at the time of image formation. When the movement speed is different from the conveying speed at the time of image formation, it is also preferable to provide a speed buffer for the recording medium P immediately before the fixation/conveyance means 30.

The printer 10 includes solvent collecting means composed of the discharge blower 50 and the solvent collecting device 52. The solvent collecting means collects the carrier liquid evaporated from the ink droplets ejected on the recording medium P from the head unit 40, in particular, the carrier liquid evaporated from the recording medium P at the time of fixing the image formed of the ink droplets.

The discharge blower 50 sucks air inside the casing 12 of the printer 10 to blow the air to the solvent collecting device 52.

The solvent collecting device 52 is provided with a solvent vapor absorber. This solvent vapor absorber absorbs solvent components of gas containing solvent vapor sucked by the discharge blower 50, and exhausts the gas whose solvent has been absorbed and collected, to the outside of the casing 12 of the printer 10. Various active carbons are preferably used as the solvent vapor absorber.

As described above, the image recording on the recording medium P is performed by the respective ink jet heads 48 of the head unit 40 to which a drive voltage in accordance with the image to be recorded is supplied from the ejection control means 44. The ink jet head 48 is an electrostatic ink jet head using ink prepared by dispersing the colorant particles (charged fine particles which contain a colorant) into the carrier liquid.

Figure 2:
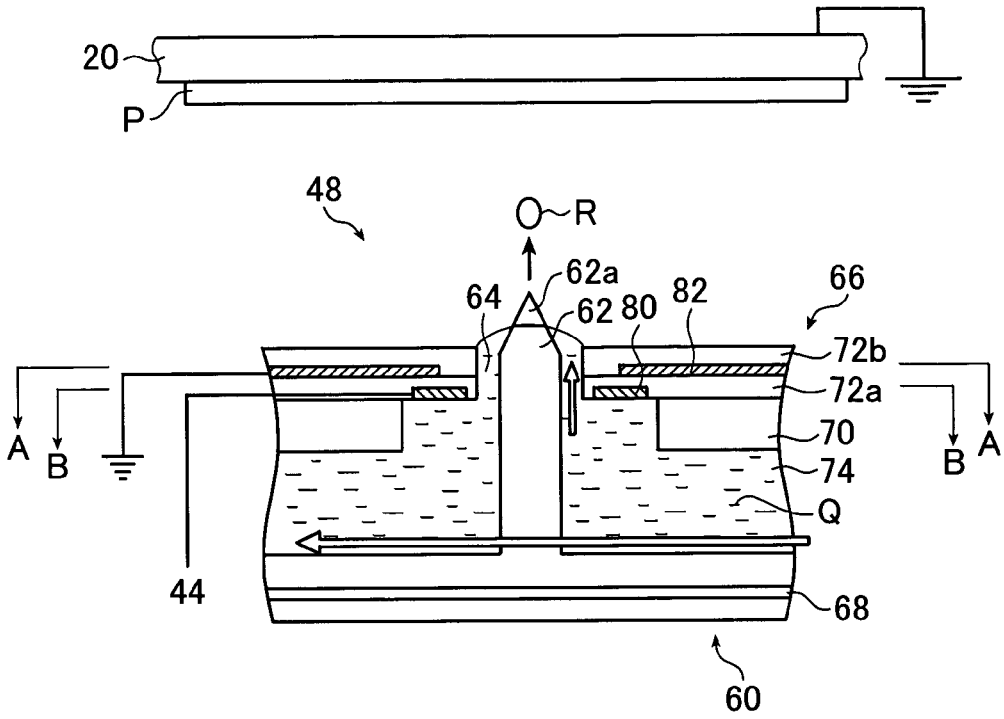
FIG. 2 is a conceptual diagram illustrating an ink jet head of the ink jet printer shown in FIGS. 1A and 1B.
Figure 3A:
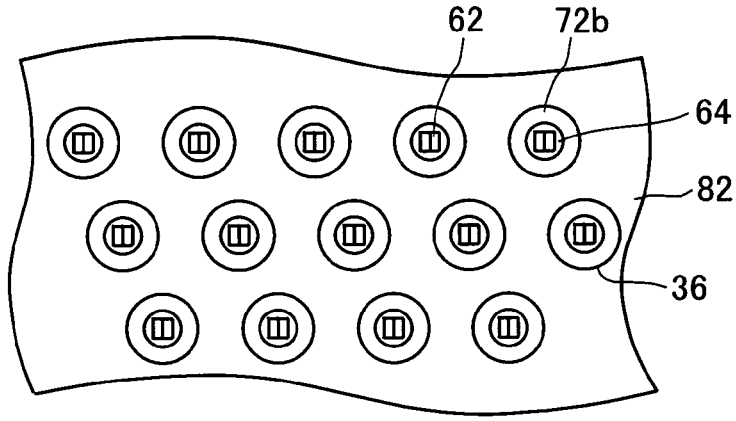
FIGS. 3A and 3B are each a conceptual diagram illustrating the ink jet head shown in FIG. 2.
Figure 3B:
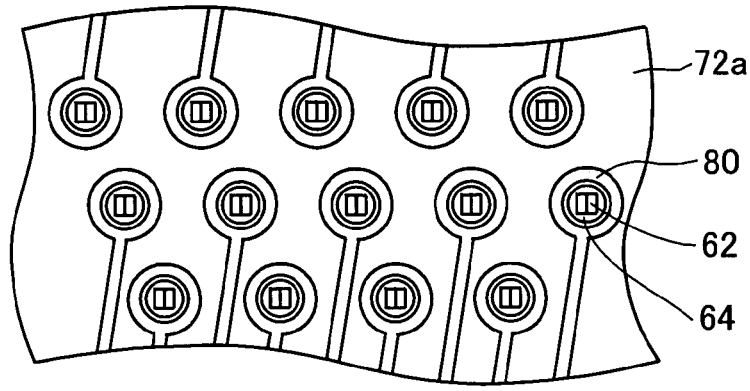

FIG. 2 is a conceptual cross sectional view schematically showing an exemplary structure of the ink jet head 48 used in the present invention, and FIGS. 3A and 3B are diagrams taken along line A—A and line B—B of FIG. 2, respectively.

The electrostatic ink jet head 48 shown in the drawings (hereinafter, referred to as head 48) is composed of a head substrate 60, an ink guide 62, and an ejection port substrate 66 having the ejection port 64. A floating conductive plate 68 is arranged inside the head substrate 60. In addition, the ejection port substrate 66 is formed by laminating an insulating substrate 70, a first insulating layer 72*a* and a second insulating layer 72*b*.

The head substrate 60 and the ejection port substrate 66 are disposed so as to face each other while being apart by a predetermined distance, with the gap defined by those substrates functioning as the ink flow path 74 for supplying the ink to each ejection port 64.

As described above, the electrostatic ink jet head 48 ejects the ink Q prepared by dispersing the colorant particles into the carrier liquid under an electrostatic force. Driving ON/OFF of the ejection electrode 80 (ejection ON/OFF) is controlled depending on whether or not a drive voltage supplied from the ejection control portion 44 is applied to the ejection electrode 80. Ink droplets are modulated based on the image data supplied to the ejection control portion 44 and ejected, whereby an image is recorded on the recording medium P.

As shown in FIGS. 3A and 3B, the head 48 has a multi channel structure where the ejection portions (nozzles (ejection ports 64)) are arranged two-dimensionally for high density image recording. However, for the sake of clearly representing the structure, FIG. 2 shows one ejection portion alone.

In the shown example, the head 48 is structured such that three lines of the ejection portions disposed in the sub scanning direction (lateral direction in FIGS. 3A and 3B) are arranged in the scanning conveying direction (vertical direction in FIGS. 3A and 3B) apart from one another by a predetermined distance. Then, the ejection portions in the respective lines (i.e., the ejection portions disposed in the sub scanning direction) are shifted by ⅓ pitch in the line arrangement direction, and the ejection portion of interest is situated between the ejection portions of the other lines. Therefore, in the printer 10 (head 48) of the shown example, by performing the above-mentioned scanning conveyance once, the image recording can be achieved at the recoding density three times higher than the arrangement density of each ejection portion.

However, according to the present invention, it is possible to freely choose the number of the ejection electrodes of the heads 48 and the physical arrangement thereof. For example, the structure may be the multi channel structure of the shown example or a structure having only one line of the ejection portions. In addition, the printer of the shown example is adapted to record a full color image with four colors, but the present invention can cope with a monochrome recording apparatus and a color recording apparatus as well.

In the head 48 of the shown example, the ink guide 62 is formed of a ceramic flat plate with a predetermined thickness having a convex tip end portion 62*a*, and disposed on the head substrate 60 for each ejection portion.

The ejection port 64 for ejecting the ink droplets R is formed while penetrating through the ejection port substrate 66 as will be described later. The ink guide 62 is disposed corresponding to each ejection port 64 (ejection portion) and passes through the ejection port 64. The tip end portion 62*a* of the ink guide 62 projects above the surface of the ejection port substrate 66 on the recording medium P side (surface of the second insulating layer 72*b* on the upper side in the drawing (hereinafter, this side is regarded as upper side and the other side is regarded as lower side)). Note that a notch functioning as an ink guide groove for guiding the ink Q to the tip end portion 62*a* through the capillary phenomenon may be formed in the vertical direction in FIG. 2 in a center portion of the ink guide 62.

In the shown example, the ink guide 62 on the tip end portion 62*a* side is processed to be upwardly tapered and to have a substantially triangular shape (or a trapezoidal shape). The shape of the ink guide 62 is not particularly limited as long as the ink Q, more specifically, the colorant particles in the ink Q are allowed to pass through the ejection port 64 of the ejection port substrate 66 and to be concentrated at the tip end portion 62*a*. For example, the tip end portion 62*a* is not necessarily convex but the shape may be appropriately changed, and a known shape can be used as well.

According to the present invention, a metal is preferably vapor-deposited onto a distal end portion of the ink guide 62. With the vapor-deposition of the metal, the tip end portion 62*a* of the ink guide 62 has practically large permittivity to facilitate generation of an intense electric field, thereby improving ink ejection properties.

In a preferable mode, the floating conductive plate 68 in an electrically insulated state (high impedance state) is disposed inside the head substrate 60.

With the provision of the floating conductive plate 68, a voltage induced in accordance with the drive voltage applied to the ejection electrode 80 is generated at the time of image recording. Moreover, this induced voltage automatically varies in accordance with the number of movable channels. This induced voltage causes the colorant particles of the ink Q to migrate toward the ejection port substrate 66 inside the ink flow path 74 as will be described later. As a result, it is possible to concentrate the ink Q with stability. More specifically, the migration due to the induced voltage improves the concentration of the colorant particles in the upper layer of the ink flow path 74, and also improves the concentration of the colorant particles of the ink Q arriving at the ejection port 64 of the ejection port substrate 66. Consequently, improvement in condensation of the colorant particles in the meniscus of the ink Q as will be described later is achieved and the concentration of the colorant particles in the ink Q ejected as the ink droplets R can be maintained in an adequate high concentration.

In consideration of the above effects, it is necessary to arrange the floating conductive plate 68 below the ink flow path 74 (at a position further apart from the ejection port substrate 66 with respect to the ink flow path 74). Also, the floating conductive plate 68 is preferably situated on the upstream side of the ink flow path 74 with respect to a position of the ejection electrode 80.

In the shown example, the floating conductive plate 68 is arranged inside the head substrate 60. However, the floating conductive plate 68 may be arranged at an arbitrary position as long as this position is below the ink flow path 74. For example, the floating conductive plate 68 may be positioned below the head substrate 60 or positioned on the upstream side of the ink flow path 74 with respect to a position of the ejection electrode 80 and inside the head substrate 60.

As described above, the head substrate 60 and the ejection port substrate 66 are disposed apart from each other by a predetermined distance, and the gap defined by those substrates forms the ink flow path 74 functioning as an ink reservoir (ink chamber) for supplying the ink Q to the ejection port 64 (ink guide 62).

It should be noted that the ink Q circulates in a predetermined direction at the time of image recording by the ink circulating device 42*a:* in the shown example, the ink circulates in the ink flow path 74 from the right to the left in the drawing at a predetermined speed (for example, at an ink flow rate of 200 mm/s).

The ejection port substrate 66 is formed by laminating the insulating substrate 70, the first insulating layer 72*a,* and the second insulating layer 72*b.* The ejection ports 64 for ejecting the ink droplets R are formed so as to penetrate through the substrate. The ink guide 62 penetrates through each ejection port 64 with its tip end protruding upward.

In addition, the ejection port substrate 66 has the ejection electrode 80 formed for each ejection port 64, and further a guard electrode 82 is formed between the respective ejection electrodes 80. The ejection port 64, the ejection electrode 80, the ink guide 62, and the like constitute one ejection portion.

In the shown example, as a preferable mode, the ejection electrode 80 is exposed to the ink flow path 74 so as to contact the ink Q. With this structure, when a drive voltage is applied to the ejection electrode 80 (ejection is ON), a part of charge supplied to the ejection electrode 80 is supplied to the ink Q, and conductivity of the ink Q in the vicinity of the ejection portion becomes high. As a result, the ink Q comes into a state where the ink droplets R are easily ejected only when the ejection is ON, thereby improving ejection properties significantly.

The present invention should not be construed restrictively; the ejection electrode 80 may be sealed as in a normal electrostatic ink jet head so that the electrode 80 does not contact the ink Q. Alternatively, a structure may be adopted where the ejection electrode 80 is exposed to the ejection port 64, thereby contacting the ink Q. However, the above-mentioned effects become profound when a large area of the ejection electrode contacts the ink Q. Hence, when the ejection electrode 80 is exposed to the ink flow path 74 as in the shown example, more significant effects can be obtained.

The ejection electrode 80 is disposed as a ring-shaped circular electrode on the lower side of the first insulating layer 72*a* (surface of the head substrate 60 side) and on the upper side of the insulating substrate 70 in the drawing, that is, on the side of the recording medium P, so as to surround the ejection port 64 which penetrates through the ejection port substrate 66. As described above, the ejection electrode 80 is supplied with a drive voltage of a predetermined potential based on ejection data (ejection signal) such as image data and printing data from the ejection control portion 44 to control driving ON/OFF of the ejection electrode.

As described above, in the shown example, the multi channel structure is adopted where the ejection ports 64 are arranged two-dimensionally, and therefore as shown in FIG. 3B, the ejection electrodes 80 are of course two-dimensionally arranged for the respective ejection ports 64.

Note that the ejection electrode 80 is not limited to the ring-shaped circular electrode but may take various shapes. Preferable examples include a circumferential electrode disposed so as to surround the outer periphery of the ejection port 64 (a part of which may be notched). Especially, a substantially circular electrode is preferred, and a circular electrode is more preferred.

The guard electrode 82 is formed on the first insulating layer 72*a,* with the surface covered with the second insulating layer 72*b.* As shown in FIG. 3A, the guard electrode 82 is a sheet-like electrode such as the metal plate common to the respective ejection electrodes, and openings 36 corresponding to the ejection electrodes 80 are formed around the two-dimensionally disposed ejection ports 64.

According to a preferable mode, the guard electrode 82 is provided to shield from an electrical line of force between the adjacent ejection electrodes 80 and to suppress electrical field interference between the adjacent ejection electrodes 80, and receives application of a predetermined voltage (including 0 V due to grounding). In the shown example, the guard electrode 82 is grounded to have 0 V. With the provision of the guard electrode 82, the electrical field interference between the adjacent ejection electrodes 80 is preferably suppressed.

In the above example, the guard electrode 82 is composed of a sheet-like electrode but the present invention is not limited to this. An arbitrary electrode may be adopted as long as this electrode is provided so as to shield from an electrical line of force of another channel between the ejection portions. For example, the guard electrode 82 may be provided in a mesh shape between the ejection portions. Alternatively, the guard electrode 82 may not be provided in a position where the ejection portions are sufficiently far from each other so that the electric field interference is not generated but may be provided in a position where the ejection portions are close to each other.

In such a case as well, the guard electrode 82 may be formed such that, with respect to the ejection electrode 80 of its own channel, its inner peripheral portion is situated farther away from the ejection port 64 than an inner peripheral portion of the ejection electrode 80 and closer to the ejection port 64 than an outer peripheral portion of the ejection electrode 80.

Hereinafter, ejection operation for the ink droplets R in the head 48 will be described.

As described above, upon recording, the ink Q is circulated by the ink circulating device 42*a* where the ink Q (for example, the colorant particles are positively charged) flows in a direction shown by an arrow (from the right to the left in FIG. 2) in the ink flow path 74 in the head 48. The floating conductive plate 68 is placed in an insulating state (high impedance state).

On the other hand, the recording medium P on which an image is to be recorded is charged to have the polarity opposite to that of the colorant particles, that is, a negative high voltage (for example, −1500 V) by the electrostatic attraction means 24. While being charged to the bias voltage, the recording medium P is attracted to the conveyor belt 20 to be conveyed to a position corresponding to the head unit 40.

In this state, the recording medium P is subjected to scanning and conveyance by the conveyor belt 20 (the head 48 and the recording medium are relatively moved), while the ejection control means 44 applies a drive voltage based on image data supplied as described above to the respective ejection electrodes 80. Through controlling ON/OFF of the drive voltage application (ON/OFF of driving the respective ejection electrodes 80), ejection is ON/OFF, whereby the ink droplets R are modulated based on the image data and ejected to record the image on the recording medium P.

Here, when the drive voltage is not applied to the ejection electrode 80 (or the applied voltage is at a low voltage level) i.e., in a state where the bias voltage by the recording medium P is only applied, Coulomb attraction between the bias voltage and the charge of the colorant particles (charged particles) of the ink Q, Coulomb repulsive force between the colorant particles, viscosity, surface tension, and dielectric polarization force of the carrier liquid, and the like act on the ink Q. Owing to the combination of those, the colorant particles and the carrier liquid move, and as schematically shown in FIG. 2, the meniscus of the ink Q in the ejection port 64 is slightly raised from the level of the ejection port 64 to thereby obtain a balance.

Furthermore, with this Coulomb attraction and the like, the colorant particles move toward the recording medium P charged to the bias voltage due to so-called electrophoresis. To elaborate, the ink Q is condensed in the meniscus of the ejection port 64.

From this state, the drive voltage is applied to the ejection electrode 80. Accordingly, the drive voltage is superposed on the bias voltage, and movement occurs due to further combination of the drive voltage superposition and the above-mentioned combination. The colorant particles and the carrier liquid are attracted to the bias voltage (counter electrode) side, that is, the recording medium P side, by the electrostatic force. The above meniscus then grows to have a substantially conical ink liquid column so-called Taylor cone, formed from the above. Also, similar to the above, the colorant particles move toward the meniscus due to the electrophoresis, and the ink Q of the meniscus is therefore condensed to contain the large number of the colorant particles and achieves substantially uniform high concentration state.

After starting the application of the drive voltage, when a limited period of time elapses, the movement of the colorant particles or the like at the tip end of the meniscus having high electric field intensity causes unbalanced surface tension mainly between the colorant particles and the carrier liquid, and the meniscus dramatically extends to form an elongated ink liquid column called "string" having about several μm to several tens of μm in diameter.

As a limited period of time further elapses, the string grows. The interaction of the growth of this string, vibration due to Rayleigh-Weber instability, nonuniform distribution of the colorant particles in the meniscus, nonuniform distribution of electrostatic field acting on the meniscus, and the like separates the string to form the ink droplets R to be ejected/flown. Also, the ink droplets R are attracted owing to the bias voltage to the recording medium P. It should be noted that the growth and separation of the string and further the movement of the colorant particles to the meniscus (string) are generated in succession during the drive voltage application.

When a limited period of time elapses after the end of the application of the drive voltage (ejection is OFF), the meniscus returns to the above-mentioned state where only the bias voltage is applied.

As is apparent from the description, in the electrostatic ink jet recording using the ink including the colorant particles (charged fine particles containing the colorant), after applying the drive voltage to the ejection electrode 80, it takes a certain time period to have the ink droplet actually ejected (hereinafter, referred to as ejection delay).

Figure 4:
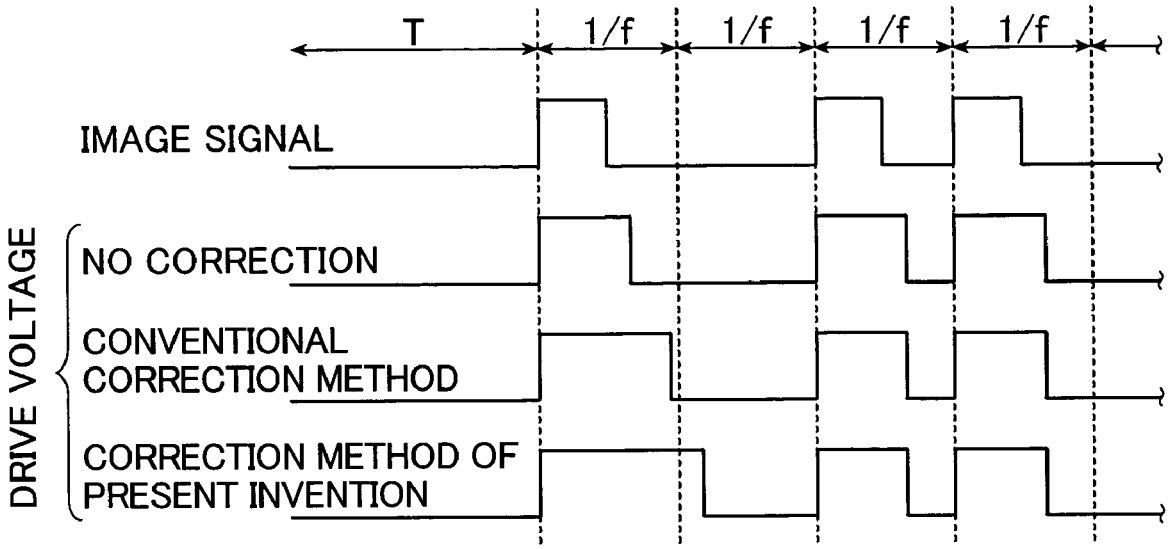
FIG. 4 is a conceptual diagram illustrating electrostatic ink jet recording according to the present invention.

The drive voltage is usually applied at a predetermined pulse width corresponding to the duty in accordance with a pulse signal. In other words, a pulsed drive voltage is applied to the ejection electrode 80 in accordance with an image signal for ejection ON as shown in FIG. 4, column "NO CORRECTION". One dot of the ink on the recording medium P is usually formed by the application of the drive voltage for one time (one pulse). Upon the drive voltage application, the dot is formed by ejecting a plurality of ink droplets into which the string had been separated as described above.

However, when the ejection delay is significant, the amount of the ink droplets ejected by each application of the drive voltage becomes accordingly smaller, resulting in a phenomenon where the dot diameter formed on the recording medium becomes smaller than a predetermined size. Furthermore, it takes a certain time period to return to a meniscus state where only the bias voltage is applied after the end of the drive voltage application, a difference in ejection delay occurs due to the history prior to the ejection start.

To solve the above problem, according to JP 10-258511 A described above, as shown in FIG. 4, column "CONVENTIONAL CORRECTION METHOD", a pulse width for applying the drive voltage is adjusted (set longer) in accordance with the image to be recorded to eject an appropriate amount of the ink, thereby avoiding the smaller dot diameter phenomenon owing to the ejection delay.

Here, according to the conventional correction method as disclosed in JP 10-258511 A or the like, the maximum pulse width after the correction is shorter than 1/f where f is the drive frequency of the ejection electrode, that is, the ejection frequency for one dot of the ink droplets (pulse signal generation frequency=recording frequency).

However, the ejection delay is conspicuous after stopping the ejection of the ink droplets. Therefore, at several pulses when restarting the ejection after the ejection has been stopped for a certain time period, the ejection of the ink droplets is not stable even when the pulse width is set at the maximum value corresponding to the 1/f. Hence, the smaller dot diameter phenomenon owing to the ejection delay cannot be sufficiently corrected. In particular, when the image recording is performed at a high speed (high drive frequency), such drawbacks become serious. For this reason, according to the conventional correction method as disclosed in JP 10-258511 A, when the recording for one image is started or when an image requires that several ejection portions stop the ejection for a long period of time, an area where the dot diameter of the ink becomes smaller in the image is generated, and thus an image with an appropriate quality cannot be recorded with stability.

In contrast, according to the present invention, in the electrostatic ink jet recording using the above-mentioned ink Q prepared by dispersing the colorant particles into the insulating carrier liquid, the pulse width upon ejection restart after ejection stop is set at 1/f or longer, as shown in FIG. 4, column "CORRECTION METHOD OF PRESENT INVENTION". That is, at the time of ejection restart when the ejection delay is most significant, the pulse width is set considerably longer than the usual case. As a result, the significant ejection delay caused by the ejection stop is cancelled simultaneously at the time of ejection restart. The ejection of the ink droplets after the ejection restart including the ejection at the first pulse is stabilized. Accordingly, even when the recording is performed at a high speed, it is possible to eject an adequate amount of ink droplets with stability.

Therefore, according to the present invention, even in a case where the image recording is performed at a high speed, when restarting the ejection after the ejection of the ink droplets has been stopped for a certain time period, the smaller dot diameter phenomenon owing to the ejection delay can be certainly avoided with stability. In other words, it is possible to perform the image recording with an appropriate and uniform dot diameter irrespective of an image to be recorded, whereby a high quality image can be recorded at a high speed with stability.

It should be noted that an absolute value in the ejection stop cannot be uniquely determined in the present invention, which may be appropriately determined based on characteristics of the system performing the electrostatic ink jet recording such as characteristics of the apparatus (head), characteristics of the ink Q to be used, the ejection frequency f, the electrostatic force acting on the ink Q including the drive voltage and the bias voltage, and the desired ink ejection amount for one dot.

For example, a method is shown with which the ejection portion where the ejection of the ink droplets is stopped for an appropriately determined number of dots or more is regarded as the portion where the ejection is stopped, and the pulse width of which at the time of ink droplet ejection restart is set at 1/f or longer; and the ejection portion where the ejection of the ink droplets is stopped but the ejection stop is for not larger than the predetermined number of dots is regarded as the portion where the ejection is not stopped, and the maximum pulse width of which at the time of ejection restart is set smaller than 1/f.

In addition, another method is shown with which the ejection portion where the ejection of the ink droplets is stopped for an appropriately determined time period or longer is regarded as the portion where the ejection is stopped, the pulse width of which at the time of ink droplet ejection restart is set at 1/f or longer; and the ejection portion where the ejection of the ink droplets is stopped but the ejection stop is for not longer than the determined time is regarded as the portion where the ink droplet ejection is not stopped, and the maximum pulse width of which is set smaller than 1/f.

Upon recording start for the next image after one sheet of image has been recorded or upon recording the first image after the apparatus has been activated, all of the ejection portions consequently will naturally have the ejection restart state, and thus the pulse width for the first one pulse (first one dot) in all of the ejection portions is set at 1/f or longer.

Further, according to the present invention, in addition to the first one pulse (first one dot) as described above for the time of ejection restart, the pulse width of the drive voltage is preferably adjusted for setting the appropriate dot diameter as the need arises. As a result, deterioration in image quality caused by the smaller dot diameter phenomenon owing to the ejection delay is more preferably avoided.

The adjustment for the pulse width may be performed by a known method such as one performed in accordance with an image to be recorded as disclosed in JP 10-258511 A, for example.

According to the present invention, the pulse width for the first one pulse after stopping the ejection of the ink droplets is not particularly limited, and may be appropriately set at a value in accordance with characteristics of the system performing the electrostatic ink jet recording such as the ink Q to be used, the drive voltage, and the bias voltage. Studies made by the inventor of the present invention show that the pulse width for the first one pulse after stopping the ejection of the ink droplets is preferably adjusted in a range of 1/f to 2/f, and it is particularly preferable that the adjustment be performed in this range in accordance with the ejection stop state.

Whether or not the ejection portion stops the ejection may be acknowledged by, for example, analyzing the supplied image data (or image data for ejection) by the ejection control portion 44. To this method, a mode in which the pulse width is extended forward as will be described later is suitably applicable. Alternatively, the acknowledgement may be enabled by measuring the number of continuous non-ejection pulses for each ejection portion when the ejection is not performed.

Here, in the shown example, the pulse width of the drive voltage at the time of ejection restart for the first pulse is extended (backward) to an area corresponding to the next pulse (second pulse), and the pulse width for the first one pulse after the ejection stop is set at 1/f or longer. However, the present invention should not be construed restrictively; the pulse width may be extended forward with respect to the time of the usual drive voltage application for the first pulse (that is, in FIG. 4, the drive voltage is raised from an area of a stop time period T) to set the pulse width of the drive voltage for the first pulse at the time of ejection restart at 1/f or longer, or the pulse width may be extended both forward and backward with respect to the first pulse to set the pulse width of the drive voltage for the first pulse at the time of ejection restart at 1/f or longer.

With the correction method according to the present invention illustrated in FIG. 4, when there is an image signal for ejection ON at the second pulse, a result is obtained in which the drive voltage is applied at the first pulse and at the second pulse continuously. At this time, depending on the state of the ink Q (concentration of the colorant particles in particular), the above-mentioned condensation of the ink is not sufficiently performed, which may result in that the ink droplets to be ejected are diluted and the image bleeding or the like occurs. In contrast, the rise of the drive voltage is set earlier to extend the pulse width for the first pulse forward to be set at 1/f or longer, thus preventing the continuous application of the drive voltage at the first pulse and at the second pulse.

Incidentally, disclosed in JP 62-18272 A is a method for the electrostatic ink jet recording which uses conductive ink unlike the present invention using the ink prepared by dispersing the colorant particles (charged fine particles containing the colorant) into the insulating carrier liquid. In the ink jet recording method, the pulse width of the drive voltage is set larger than 1/f but smaller than 2/f based on the drive frequency f for reducing the drive voltage.

This ink jet recording method is employed for the electrostatic ink jet recording using the above ink Q including the colorant particles as in the present invention, whereby the smaller dot diameter phenomenon owing to the ejection delay can be avoided as well.

However, in this method, a result is obtained in which the drive voltage is continuously applied without interruption to the ejection portion where the ejection has been kept ON.

As described above, in the ink jet recording according to the present invention which uses the ink Q prepared by dispersing the colorant particles into the insulating carrier liquid, the ink is condensed in the ejection portion to perform the ejection of the ink droplets. In a system disclosed in JP 62-18272 A which uses conductive ink and does not perform the condensation of the ink, even when the drive voltage is continuously applied, no problems occur at all. However, in the system where the ink is condensed as in the present invention, when the drive voltage is continuously applied to eject the ink droplets R, the condensation of the ink in the ejection portion is not in time, resulting in decrease in concentration of the colorant particles in the ink droplets to be ejected, i.e., many of the ink droplets R are composed of the carrier liquid, and image bleeding occurs on the recording medium P.

Therefore, it is still preferable that the pulse width be set at 1/f or longer only at the first one pulse when restarting the ejection after the ejection stop as in the present invention. Moreover, once the pulse width is set at 1/f or longer only at the first one pulse, if the pulse width of the drive voltage is adjusted in the usual range of shorter than 1/f, the smaller dot diameter phenomenon owing to the ejection delay can be avoided with stability.

In the above examples, while the electrostatic ink jet recording apparatus for recording the color image using the ink of four colors including C, M, Y, and K has been described, the present invention should not be construed restrictively; the apparatus may be a recording apparatus for a monochrome image or an apparatus for recording an image using an arbitrary number of other colors such as pale color ink and special color ink, for example. In such a case, the head units 40 and the ink circulating systems 42 whose number corresponds to the number of ink colors are used.

Furthermore, in either case of the above examples, the ink jet recording in which the ink droplets R are ejected by positively charging the colorant particles in the ink and charging the recording medium P or the counter electrode on the rear side of the recording medium P to the negative high voltage has been described. However, the present invention is not limited to this. The ink jet image recording may be performed by negatively charging the colorant particles in the ink and charging the recording medium or the counter electrode to the positive high voltage. When the charged colored particles have the polarity opposite to that in the above-mentioned example, the applied voltage to the electrostatic attraction means, the counter electrode, the drive electrode of the ink jet head, or the like may have the polarity opposite to that in the above-mentioned example.

The ink jet recording method and the ink jet recording apparatus according to the present invention have been described in detail; the present invention is not limited to the above embodiments. It will be obvious that various modifications and changes can be made without departing from the scope of the present invention.

What is claimed is:

1. An electrostatic ink jet recording method, comprising the steps of:

applying an electrostatic force to ink including charged fine particle components;

ejecting ink droplets from ejection portions of an ink jet head;

forming at least one dot at an ejection frequency f on a recording medium; and recording an image on said recording medium, further comprising the step of:

setting an application time period of a drive voltage for ejecting said ink droplets upon ejection restart after ejection stop to a time period of 1/f or longer for at least one ejection portion.

2. The ink jet recording method according to claim 1, wherein said setting step sets said application time period of said drive voltage for ejecting said ink droplets to said time period of 1/f or longer for an ejection portion where an ejection stopping state in which no ink droplet is ejected satisfies a predetermined condition, and set said application time period to a time period shorter than 1/f for an ejection portion where said ejection stopping state does not satisfy said predetermined condition.

3. The ink jet recording method according to claim 1, wherein said setting step adjusts said application time period of said drive voltage for ejecting said ink droplets upon the ejection restart in a range of 1/f to 2/f in accordance with an ejection stopping state where no ink droplet is ejected.

4. An electrostatic ink jet recording apparatus for applying an electrostatic force to ink including charged fine particle components to eject ink droplets from ejection portions of an ink jet head and forming at least one dot at an ejection frequency f on a recording medium to record an image on said recording medium, comprising:

an ejection port substrate having ejection ports for ejecting said ink droplets;

a head substrate disposed so as to face said ejection port substrate while being apart at a predetermined distance;

respective ejection electrodes for ejecting said ink droplets from said ejection ports, each of said ejection electrode being formed corresponding to each of said ejection ports and adapted to apply an electrostatic force to said ink for ejecting said ink droplets to allow said ink droplets to be ejected from said ejection ports; and ejection control means for applying to at least one ejection electrode a drive voltage for ink droplet ejection to drive said at least one ejection electrode, said ejection control means applying said drive voltage to said at least one ejection electrode for a time period of 1/f or longer upon ejection restart after ejection stop.

5. The ink jet recording apparatus according to claim 4, Wherein an ejection portion includes an ejection port and an ejection electrode, and wherein said ejection control means applies said drive voltage to said ejection electrode for said time period of 1/f or longer in an ejection portion where an ejection stopping state in which no ink droplet is ejected satisfies a predetermined condition, and for a time period shorter than 1/f in an ejection portion where said ejection stopping state does not satisfy said predetermined condition.

6. The ink jet recording apparatus according to claim 4, Wherein said ejection control means adjusts said application time period of said drive voltage applied to said at least one ejection electrode upon the ejection restart after the ejection stop in a range of 1/f to 2/f in accordance with an ejection stopping state where no ink droplet is ejected.

7. The ink jet recording apparatus according to claim 4, Wherein said ejection control means applies said drive voltage to said at least one ejection electrode for said time period of 1/f or longer by one of:

starting application of said drive voltage at a timing earlier than start of predetermined voltage application in accordance with said ejection frequency f;

terminating voltage application at a timing later than latest termination of the voltage application in accordance with said ejection frequency f; and starting the application of said drive voltage at the timing earlier than the start of the predetermined voltage application in accordance with said ejection frequency f and terminating the voltage application at the timing later than latest termination of the voltage application in accordance with said ejection frequency f.

* * * * *